United States Patent [19]

Bibollet

[11] 4,346,628

[45] Aug. 31, 1982

[54] METHOD FOR MAKING A HEAD OF PIOLET

[76] Inventor: Jean-Claude Bibollet, F-Glapigny-74230-Thones, France

[21] Appl. No.: 102,425

[22] Filed: Dec. 11, 1979

[30] Foreign Application Priority Data

Dec. 12, 1978 [FR] France ..... 78 36054

[51] Int. Cl.[3] ..... B25D 7/00

[52] U.S. Cl. ..... 76/109; 125/43; 30/164.8; D8/11; 7/159; 172/380

[58] Field of Search ..... 76/109, 101 R; 113/116 R; 125/41, 42, 43, 40; 30/164.5, 164.8; 7/159; 172/371, 377, 380, 13, 381; D8/11, 75, 76, 81, 105

[56] References Cited

U.S. PATENT DOCUMENTS

| | | | |
|---|---|---|---|
| 159,332 | 2/1875 | Johnson | 172/380 |
| D. 194,923 | 4/1963 | Grover | D8/75 |
| 323,130 | 7/1885 | Ells | 172/371 |
| 1,129,052 | 2/1915 | Senn | 76/109 |
| 3,735,434 | 5/1973 | Penberthy | 30/164.8 |

FOREIGN PATENT DOCUMENTS

| | | | |
|---|---|---|---|
| 1703464 | 1/1978 | Fed. Rep. of Germany | 30/164.5 |

*Primary Examiner*—Roscoe V. Parker
*Attorney, Agent, or Firm*—Larson & Taylor

[57] ABSTRACT

A method is provided which produces a head of piolet, all in one piece, by punching out a metallic blank (i.e. a long cross-shaped blank whose outline is symmetrical with regard to its longitudinal axis and comprises four parts: a peen part, a pike part, and two lateral fastening flaps) from a plate of metal, and then by the folding of that metallic blank symmetrically with regard to its medial plane, along its longitudinal axis or on both sides thereof, at least along that portion of length which corresponds to the pike. The blank is eventually shaped approximately along an arc of circle which is located along the medial plane of the blank before mounting upon the handle of the piolet.

3 Claims, 12 Drawing Figures

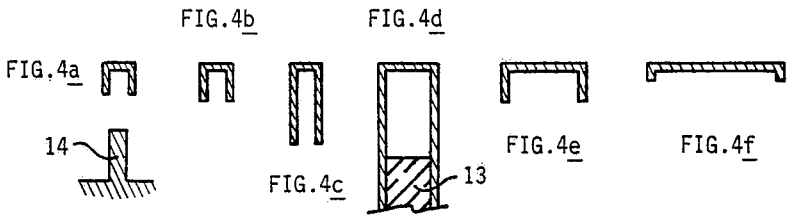
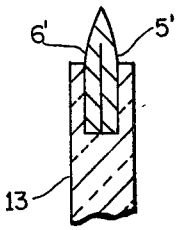
FIG. 7
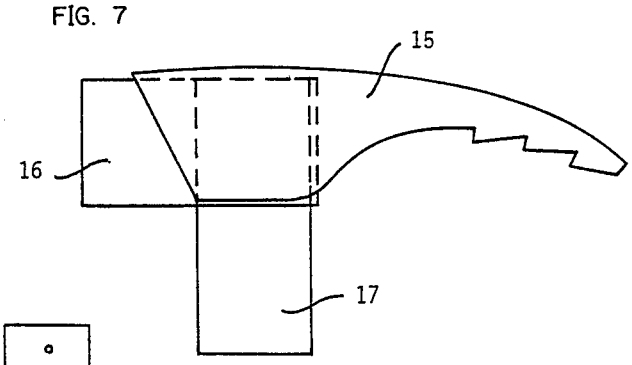
FIG. 5
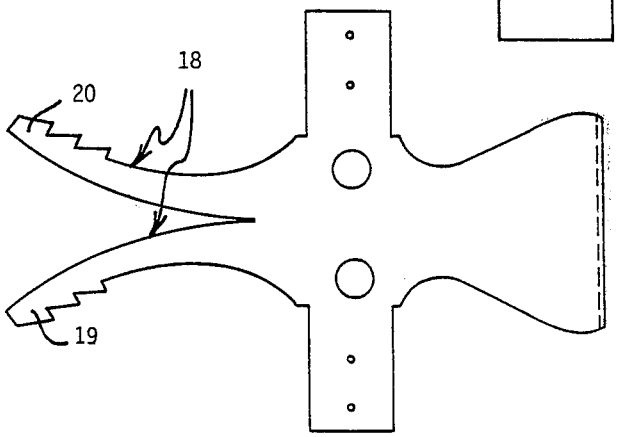
FIG. 6

METHOD FOR MAKING A HEAD OF PIOLET

FIELD OF THE INVENTION

The present invention relates to a method for making the head of a piolet or analogous tools which are used particularly for mountaineering.

BACKGROUND OF THE INVENTION

Piolets or the like (picks, piolet-hammers, etc.) which are used particularly for mountaineering, are formed of a cylindrical handle with a circular or elliptical cross-section, whose lower end is provided with a metallic tip and whose upper end is provided with a "T" shaped head. The front part of this head, or "pike", is intended to penetrate deeply to the ice and has a rectangular cross-section which grows thinner at its free fringed end. On the piolet, the rear part of the "T" shaped head, or "peen", is intended to cut the ice. This peen is almost planar and it is located perpendicularly to the handle of the piolet. On the piolet-hammers (or ice-axes) this peen is replaced by a parallelepipedic hammer-head.

The aforesaid "T" shaped head is provided with fastening flaps by which the head is mounted and kept on the handle of the piolet.

Up to now, such a head is made according either of the following methods:

According to a first method, the pike, the peen and the fastening flaps are forged together, all in one piece, into a metallic lump.

According to a second method, the pike and the peen are separately punched out of a thick plate of metal, after which the peen and the fastening flaps are welded upon the pike.

According to a third method, the peen is punched out of a plate and then shaped in a press-machine. The fastening flaps then may be obtained by the folding of parts of the peen, and the whole mounted upon the rear end of a cast solid pike and the fastening flaps secured on the handle.

Though those well known methods produce strongly built heads of piolets, they are expensive and require manual methods which need forging and/or welding operations, and cannot to be automated.

SUMMARY OF THE INVENTION

It is an object of the invention to provide a method for making a head of a piolet which avoids these disadvantages and which is simple, fast and economical, and moreover which may be easily automated and used for mass production.

This method of the invention basically comprises producing the said head, all in one piece, by punching out a metallic blank from a plate of metal and then by the folding of that metallic blank.

According to the preferred embodiment of this method, the metallic blank is punched out along an outline which is symmetrical with regard to its longitudinal axis, and then is folded symmetrically with regard to the middle or medial plane of the blank along that portion of length which corresponds to the pike and to the part of the head by which this head is mounted on the handle of the piolet.

According to a first embodiment of the method, the said folding is achived approximately along the longitudinal axis of the metallic blank and on at least the portion of length which corresponds to the pike, and the two corresponding symmetrical parts come to be placed jointedly, one close to the other, and then they may to be joined together by fastening means.

According to a second embodiment of the method, the said folding is achieved on both sides of the longitudinal axis of the metallic blank and symmetrically with regard to its medial plane, at least along that portion of length which corresponds to the pike, so that the two folded parts are parallel, non-joined and delimit between them a channel with a "U" shaped cross-section.

According to a variant of the first embodiment of the said method, the portion of the metallic blank which corresponds to the pike is initially punched out according to a "V" design with two divergent prongs which are symmetrical with regard to the longitudinal axis of the blank and, after the folding, are joined side by side and form the said pike.

According to another feature of the method of the invention, the head is shaped approximately along an arc of a circle which is located along the medial plane of the metallic blank, by means of a curving operation which is achieved during or after the folding of the blank.

Other features, additional objects, and many of the attendant advantages of this invention will readily be appreciated as the same becomes better understood from the following detailed description of a preferred method when considered in connection with the appended drawings.

BRIEF DESCRIPTION OF THE DRAWINGS

FIGS. 4*a*, 4*b*, 4*c*, 4*d*, 4*e*, 4*f* are cross-section views of this head of the piolet, according to another form, taken along lines A, B, C, D, E and F of FIG. 3;

FIG. 5 shows one side of an ice-axe or piolet-hammer which is obtained from another form of the method of the invention, and, FIG. 6 shows a punched out blank which is intended to form a whole head of a piolet and whose part corresponding to the pike is punched out according to a "V" design.

FIG. 7 is a cross-sectional view, taken along line D of FIG. 3, showing a variation of the invention.

DESCRIPTION OF THE PREFERRED EMBODIMENTS

Figure 1:
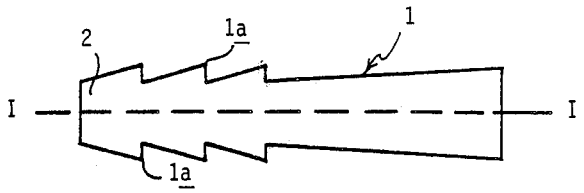
FIG. 1 shows a punched out blank which is intended to form a pike.

Referring initially to FIG. 1, a single pike is obtained, according to the method of the invention, by punching out from a plate of metal a metallic long blank 1 whose width decreases toward its end 2 which includes lateral symmetrical notches 1*a*, and then by the folding of the said blank about its longitudinal axis I—I. After a possible curving operation, the pike "P" (FIG. 1*a*) is obtained and may to be mounted upon a head of a piolet, or piolet-hammer (ice-axe), or the like.

Figure 2:
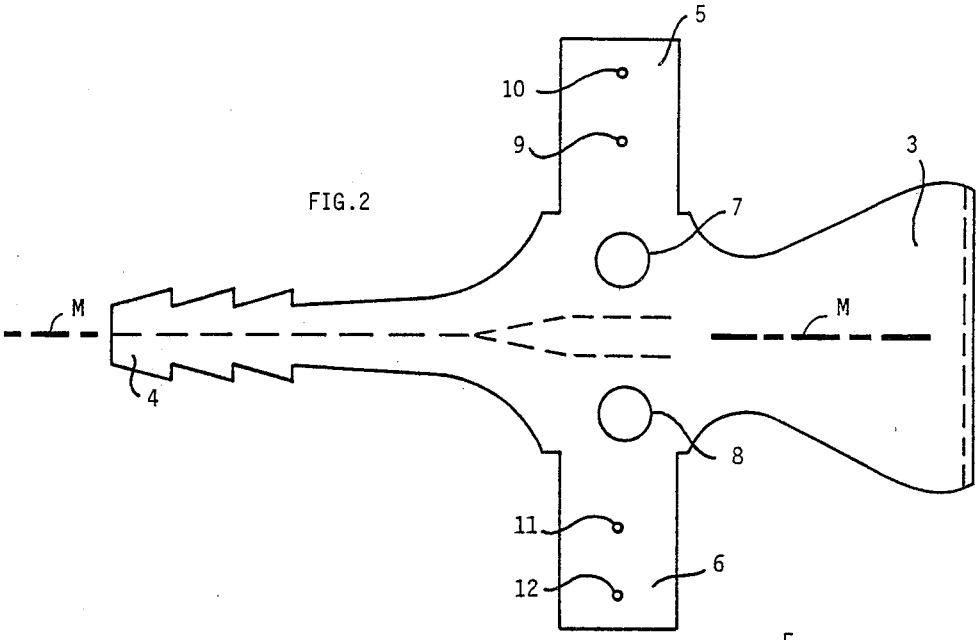
FIG. 2 shows a punched out blank which is intended to form a whole head of a piolet.
Figure 3:
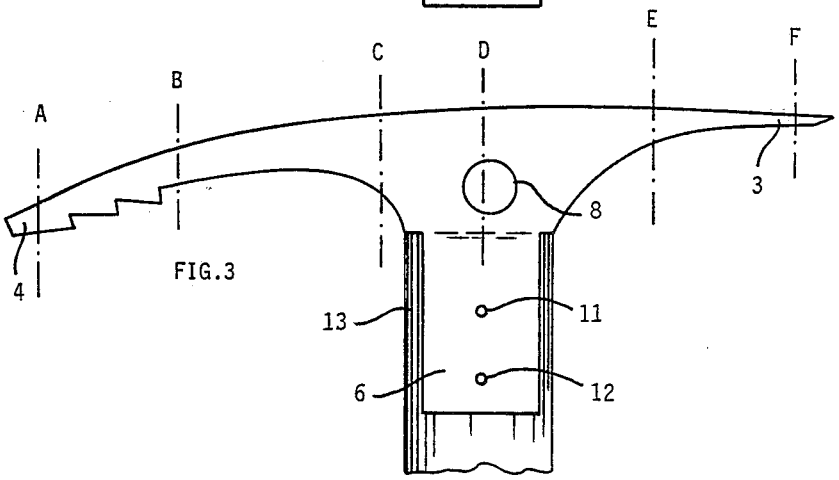
FIG. 3 shows one side the head of the piolet which is obtained from the blank shown on FIG. 2.

Referring now to FIG. 2, the entire head of a piolet is obtained, according to the method of the invention, by punching out from a plate of metal a metallic elongate cross-shaped blank whose outline is symmetrical with regard to its longitudinal axis and which comprises four branches : the first one, 3, which is approximately triangularly shaped and is intended to form the peen of the head; the second one, 4, which is intended to form the pike of the same; the third one, 5, and the fourth one, 6, which extend on both sides of the longitudinal axis of the blank and perpendicularly to the said axis. Those two branches 5 and 6 are intended to form the two fastening flaps by which the head is mounted and kept on the handle of the piolet. The branch 4 is punched out according to the same outline as on FIG. 1. The branches 5 and 6 are provided with openings 7 and 8 through which a snap-hook may pass across the head of the piolet, and with two holes 9 and 10, on the one hand, and 11 and 12, on the other hand, for the introduction of nails or rivets which fasten those flaps of the head upon the handle of the piolet. Then this head is formed by the longitudinal folding of the blank symmetrically with regard to the medial plane "M" of the same, along that portion of length which corresponds to the pike 4 and to the part of the head (flaps 5 and 6) by which this head is mounted on the handle 13 of the piolet (FIG. 3). Before being mounted on this handle 13, the head is shaped approximately along an arc of circle which is located along the mediatory plane "M" of the metallic blank, by means of a curving operation which is achieved during or after the folding of the blank.

Figure 1A:
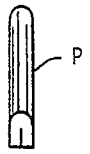
FIG. 1*a* shows frontally this pike as it is formed after the folding of the blank shown on FIG. 1.

According to a first embodiment of the method, the folding is achieved approximately along the longitudinal axis of the metallic blank (shown in dashed line on FIG. 2) on at least the portion 4 of the blank which corresponds to the pike, and the two corresponding symmetrical parts are positioned adjacent one another, one close to the other, and then they may be joined together by fastening means (welding or rivets), the same as for the pike "P" of FIGS. 1 and 1*a*.

According to a second embodiment of the method, which may to be used too for the achievement of the pike "P" of FIGS. 1 and 1*a*, the folding is, on the contrary, achieved on both sides of the longitudinal axis of the metallic blank and symmetrically with regard to its medial plane "M", at least along that portion 4 of the blank which corresponds to the pike, so that the two folded parts are parallel, spaced apart and define between them a channel with a "U" shaped cross-section. This second embodiment of the method is shown, according to successive cross-sections along lines A, B, C, D, E and F of FIG. 3, in FIGS. 4*a* to 4*f*.

According to FIGS. 4*a* to 4*f*, the head is shaped along its whole length with a right angle "U" cross-section whose width is the same all along the pike (FIGS 4*a* to 4*c*), and increases from the central part of the head (FIG. 4*d*) to the end of the peen (FIG. 4*f*).

The longitudinal folding of the blank may be achieved by means of cross-bars 14 as shown on FIG. 4*a*.

FIG. 5 shows a piolet-hammer (or ice-axe) which is provided with a hammer-head 16 mounted upon its handle 17. A pike 15, obtained by punching out and folding of a metallic blank according to the method of the invention, covers with its wider part the said hammer-head 16 to which this pike 15 is jointed by rivets or a welding operation.

According to a variant of the first embodiment of the method of the invention and as shown on FIG. 6, the portion 18 of the metallic blank which corresponds to the pike is initially punched out according to a "V" design, with two divergent curved prongs 19 and 20 which are symmetrical with regard to the longitudinal axis of the blank and, after the folding, are joined together in side by side relation, by means of rivets or a welding operation, and form a curved pike.

Likewise it is possible, according to the method of the invention, to obtain heads of piolets which have no fastening flaps and which are secured directly upon the handle of the piolet, for instance by means of a welding of the pike.

Moreover, as shown in FIG. 7 it is possible, to fold about the longitudinal axis of the blank not only the part which is intended to form the pike but also the central part of the head. In such a case, the fastening flaps 5' and 6' are also joined side by side and inserted into a slot which is provided inside the upper end of the handle of the piolet.

It should be understood, of course, that the foregoing disclosure relates only to preferred embodiments of the method of the invention, and that it is intended to cover all changes and modifications of the examples of the invention herein chosen for the purpose of illustration which do not constitute departures from the spirit and scope of the invention set forth in the appended claims.

I claim:

1. A method of making the head of a piolet or the like comprising:

producing the head, all in one piece, by punching out a metallic blank from a plate of metal to form a head including a pike section, a peen section and a mounting section having a pair of flaps for joining the head to the handle of the piolet or the like, the metallic blank being punched out with a outline which is symmetrical with respect to the longitudinal axis thereof, and then being folded symmetrically to form a crease line with respect to the medial plane of the blank along that portion of the length of the blank which corresponds to the pike section, said folding of blank taking place approximately along the longitudinal axis of the metallic blank for the portion of the length which corresponds to the pike section, the two corresponding parts which are provided in that portion of the length corresponding to the pike section being positioned closely adjacent to one another and being joined together to form the pike of the piolet or the like, the mounting section being folded at least once to form a crease line with the two flaps each extending downwardly from the crease line or lines and the peen part being essentially unfolded, viewed in a plane perpendicular to the longitudinal axis.

2. A method as claimed in claim 1 wherein the step of forming said mounting section comprises folding each of the fastening flaps to form separate, parallel, crease lines to define a top part with each flap extending downwardly therefrom, at its crease line, at an angle of approximately 90°.

3. A method as claimed in claim 1 wherein the mounting section of the head is folded about the longitudinal axis of the blank so as to form a single crease line and a pair of fastening flaps which are joined together in side by side relationship and inserted into a slot provided inside the upper end of the handle of the piolet or the like.

* * * * *